US010099261B1

(12) United States Patent
Koch

(10) Patent No.: US 10,099,261 B1
(45) Date of Patent: Oct. 16, 2018

(54) SCRAPER WITH WIDE SCRAPING EDGE

(71) Applicant: John C Koch, Kansas City, MO (US)

(72) Inventor: John C Koch, Kansas City, MO (US)

( * ) Notice: Subject to any disclaimer, the term of this patent is extended or adjusted under 35 U.S.C. 154(b) by 0 days.

(21) Appl. No.: 15/478,651

(22) Filed: Apr. 4, 2017

(51) Int. Cl.
*B26B 1/00* (2006.01)
*B08B 1/00* (2006.01)

(52) U.S. Cl.
CPC ..... *B08B 1/005* (2013.01)

(58) Field of Classification Search
CPC ..... B08B 1/005
USPC ..... 30/169, 541, 151, 155, 162
See application file for complete search history.

(56) References Cited

U.S. PATENT DOCUMENTS 3,430,339 A * 3/1969 Hobson ..... B26B 27/00 30/151
3,667,122 A * 6/1972 Black ..... B26B 29/02 30/286
4,238,883 A * 12/1980 Jacobson ..... B26B 5/005 30/162
4,517,741 A 5/1985 Castelluzzo
4,612,707 A * 9/1986 Shea ..... B26B 29/02 30/162
4,662,070 A 5/1987 Reddig
5,301,428 A 4/1994 Wilcox
5,806,189 A 9/1998 Bailey
5,940,970 A 8/1999 D'Ambro, Sr. et al.
6,286,215 B1 * 9/2001 Panaccione ..... A47L 13/022 30/169
6,865,816 B1 3/2005 Zajdel
2016/0144519 A1 * 5/2016 Hahn ..... B26B 21/227 30/50

* cited by examiner

*Primary Examiner* — Omar Flores Sanchez
(74) *Attorney, Agent, or Firm* — Erickson Kernell IP, LLC; John C. McMahon

(57) ABSTRACT

A scraper having an utility knife blade with an exposed elongate scraping edge wherein the entire edge is exposed and usable by a person using the scraper. The scraper has two parts joined by a hinge and held together during use by a pair of opposed magnets. The magnets also securely hold the blade in the body during use.

9 Claims, 3 Drawing Sheets

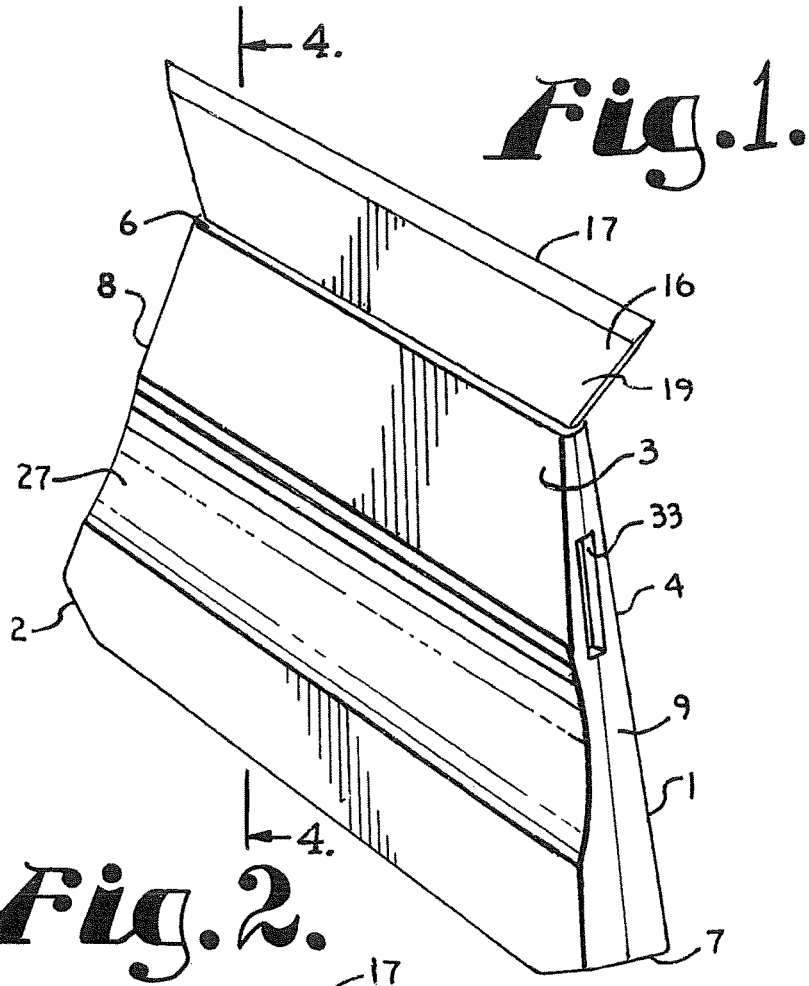
Fig.1.
Fig.2.
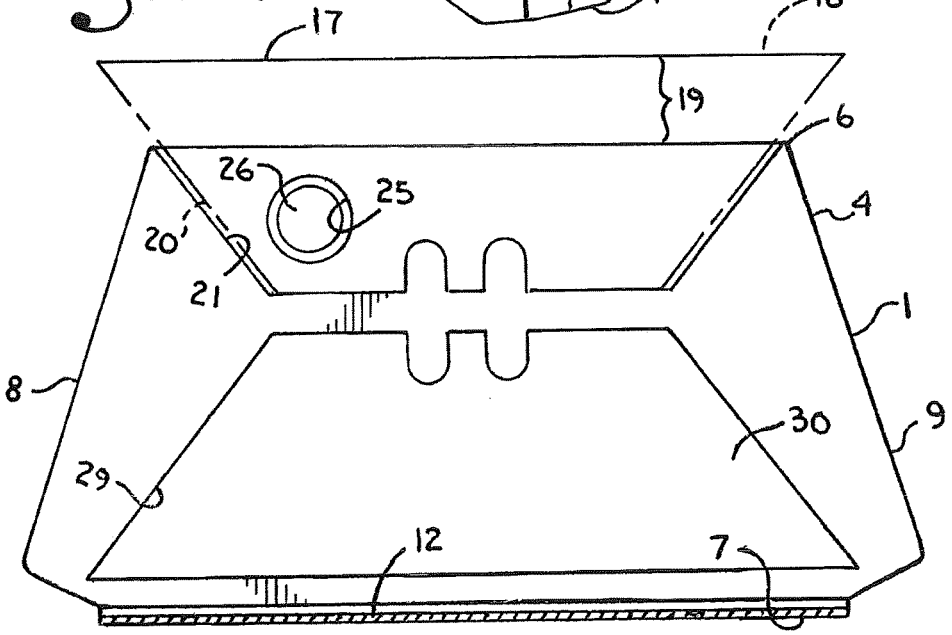

SCRAPER WITH WIDE SCRAPING EDGE

BACKGROUND OF THE INVENTION

The present invention is broadly concerned with improvements in devices used for scraping.

Many carpenters, artisans, and others find that they must often scrape a surface to smooth or recontour wood, to remove paint from wood and other materials or for many other purposes. Conventional devices of the type known as razor blade scrapers are not heavy duty and razor blades cut into surfaces being scraped and do not work well with many surfaces. A stronger and more usable elongate cutting edge is provided by conventional utility knife blades, but such are provided in holders that facilitate cutting and/or etching with just one point of the blade and such do not provide a wide sharp surface for scraping, but rather just the noted point. Some scrapers with different blades have been previously provided, but require removing screws and other fasteners, which hamper quick transfer to a new blade and require additional tools that may not be at hand, such that the user wastes substantial time getting the needed tools and changing the blade.

SUMMARY OF THE INVENTION

A scraper having a two part body wherein the two parts are operably held together by at least a pair of magnets with high Gauss surface field and which hold a utility knife blade, such that the elongate sharpened edge of the blade projects from the body and is held such that a user can apply the entire elongate edge to a work surface. The projection of the blade also exposes not only the sharpened elongate edge, but two points so that a user can not only scrape with the edge, but cut with one point and when it dulls, quickly turn the scraper around and have a second point ready to use without having to remove the blade and/or replace it.

The two parts of the body are preferably joined at a rear opposite the blade by a hinge. The body includes storage for additional blades. The body preferably includes uneven surface or gripping structure that provides recesses or projections on the surfaces to assist a user in gripping during use.

The present invention provides embodiments of an improved apparatus for scraping.

In one embodiment a scraper is disclosed for use by a work person to scrape a surface with an elongate edge comprising a body having first and second parts; the body parts having an open configuration and a closed configuration; a blade having rearward structure and an elongate edge opposite the rearward structure on a frontward structure; at least the first part having a cavity sized and shaped to snugly receive the blade rearward structure; a first and a second magnet received in the first and second body parts respectively; the magnets operably holding the body parts together and the blade within the body parts when in the closed configuration wherein the blade front end extends outwardly from the body so as to present an entire length of the edge for scrapping.

In one embodiment a scraper is disclosed for use by a work person to scrape a surface with an elongate edge comprising; a body having first and second parts; the body parts having an open configuration and a closed configuration; a hinge joining the first and second parts near a rear of each of the first and second parts; a blade having rearward structure with a periphery and elongate edge opposite the rearward structure on a frontward structure; at least the first part having a cavity with an inner surface sized and shaped to snugly receive the periphery of the blade rearward structure; a first and a second magnet secured to the first and second body parts respectively; the magnets holding the body parts together when in the closed configuration wherein the blade front end extends outwardly from the body so as to present an entire length of the edge for scrapping; a groove grip enhancing structure on the exterior of the body to aid a user in gripping the scraper; and finger holds on each of the first and second parts to allow a user to pry the first and second parts into the open configuration thereof.

In an embodiment of a method of providing a scraper for scraping a wide path comprising the steps of providing first and second body parts with a blade holding compartment; providing an utility knife blade with an elongate sharpened edge as wide as the path; placing the blade in the compartment so that an entire length of the bade sharpened edge extends from the body; fixedly securing a magnet in each of the body parts; the magnets attracting each other and holding the body together in a closed configuration of the scraper and securely holding the blade in the body when the body parts are placed in the closed configuration; the blade being removable from the body when the body parts are placed in an open configuration.

OBJECTS OF THE INVENTION

The principal object of the present invention is to provide an easy to use and highly useful scraper for various purposes, especially rough and hard to scrape surfaces requiring a strong and durable blade and where scraping of a wide path is involved.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 1 is a perspective view of a scraper in accordance with the present application.

FIG. 2 is a top plan view of a first part of a body of the scraper with a second part broken away at a hinge joining the parts, also with a blade shown in phantom to show the region beneath the blade.

DETAILED DESCRIPTION OF THE INVENTION

Figure 3:
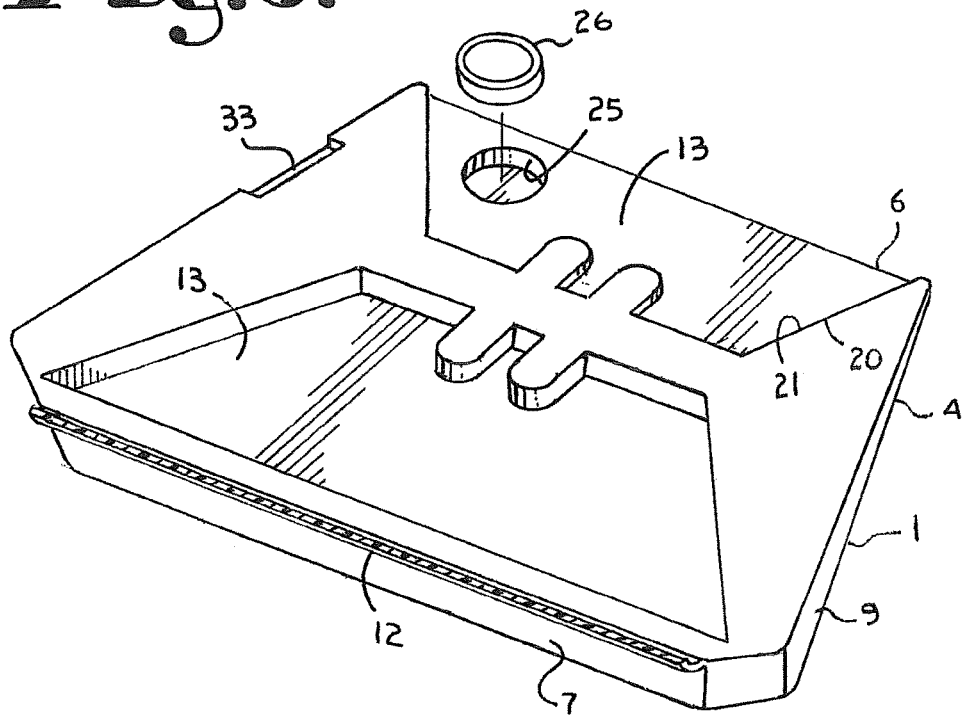
FIG. 3 is a perspective view of the first part of the body of the scraper showing the interior thereof with the hinge joining the first part of the body with the second part broken and the second part removed, also with a magnet shown in an exploded position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a scraper in accordance with the present invention. The scraper 1 has a body 2 having first and second body parts 3 and 4. The body 2 has a front end 6, a rear end 7, and sides 8 and 9. The body parts 3 and 4 are joined at a rear end 7 of each body part 3 and 4 by a hinge 12. The body parts 3 and 4 are similar in shape, especially where they mate and it is foreseen that they may be mirror images of one another or generally mirror images of each other. The body parts 3 and 4 are preferably constructed of nylon, but it is foreseen that many injection molded plastics or other materials may be used to form the parts 3 and 4.

Located in each body part 3 and 4 is a cavity 13 and 14 sized and shaped to receive a portion of an utility knife blade 16. The knife blade 16 is of a type having a trapezoidal shape with a sharpened edge 17 extending along the longest side of the blade 16. The blade edge 17 shown is greater than 2 inches in length and preferably approximately 3 and ⅜ inches wide. When assembled a rearward portion 18 of the blade 16 is fully and snugly received in the cavities 13 and 14, while a forward portion 19 of the blade 16 extends outwardly from the body 2 such that the entire blade edge 16 is fully exposed. In particular, the blade rearward portion has a periphery 20 that is closely and tightly received in an inward or blade facing surface 21 of each cavity 13 and 14. The blade 16 are thereby tightly held by the parts 3 and 4 and nested or framed by the cavities 13 and 14. The blade edge 17 is thus spaced from and generally runs parallel to the body front end 6.

Figure 4:
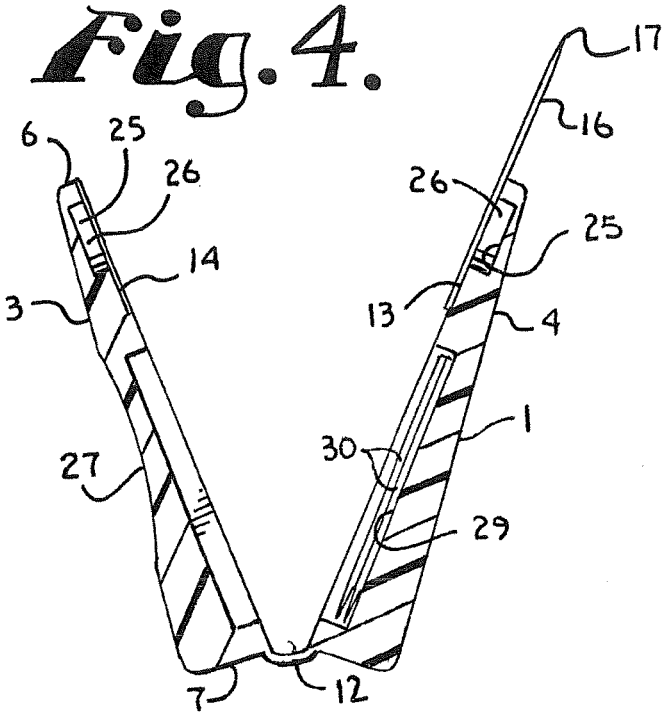
FIG. 4 is a cross sectional view of the scraper with the body parts in an open configuration, taken along line 4-4 of FIG. 1.

A circular receiver 25 is located on an interior surface of each body part 3 and 4. Positioned in each receiver 25 in each body part 3 and 4 is a magnet 26. The magnets 26 are fixedly received in each receiver 25 by high friction (press fit), adhesive or the like. The magnets 25 are positioned to be opposite each other in closely spaced relationship when the body parts 3 and 4 are closed over the blade 16. When the body parts 3 and 4 are placed in a joined or closed configuration (FIG. 1) from an open configuration (FIG. 4) by rotation about the hinge 12, the magnets 26 highly attract each other and hold the body parts 3 and 4 together in a tight facing relationship with the blade 16 held tightly therebetween. The magnets 25 and 26 also tightly and securely hold the blade 16 with the body 2, even when the blade edge 18 is utilized for intense scrapping operation. In particular, the blade 16 is constructed of a material (generally ferrous) that is susceptible to magnetic attraction and is therefore held not only by friction with the parts 3 and 4, but also by magnetic force from the magnets 26. It is foreseen that the receiver 25 may pass entirely through the parts 3 and 4 such that the magnets 26 are near on the surfaces thereof.

Preferably, the magnets 26 are each sized to be 5⁄16 inch diameter and 3⁄32 inch thick. The magnets are constructed of a neodymium, iron, and boron core with a nickel plating. The illustrated magnets each have a lifting weight of 2.2 pounds and are axially magnetized with a surface field approximately 4000 Gauss and, in particular, 3398 Gauss. Such a magnet is supplied by KJ magnets as part D503 with a grade of N-42.

It is foreseen that other magnets and other field strengths will be satisfactory for the invention, as long as the magnets 26 are capable of holding the body parts 3 and 4 closed and secure the blade 16 in the cavities 13 and 14 during use of the scraper 1. It is also foreseen that the body parts 3 and 4 may be made of plastic impregnated magnetic material.

Each body part 3 and 4 has exterior indentations, irregularities, uneven surface profiles or gripping structure 27 that are uneven to provide a user with a better grip during usage. The gripping structure 27 shown is an elongate groove, but it is foreseen that it could be various recesses or projections to make the surface less even and/or less smooth and thereby increase the friction associated therewith so as to improve the grip of a user 28.

At least one of the body parts 3 and 4 includes an interior compartment 29 that is accessible when the body parts 3 and 4 are rotated about the hinge 16, so as to expose the interior thereof. The compartment 29 is sized and shaped to hold one or more spare blades 30.

Each body part 3 and 4 may include a thumb or finger hold 33 near the body front end 6 to aide a user in separating the body parts 3 and 4 so as to expose the blade 16 to allow the user 28 to remove and replace the blade 16 when the edge 17 has become dull or damaged through use. It is foreseen that the holds 33 could be sized and shaped to receive a coin or tool (not shown) to assist in separating the parts 3 and 4.

Figure 5:
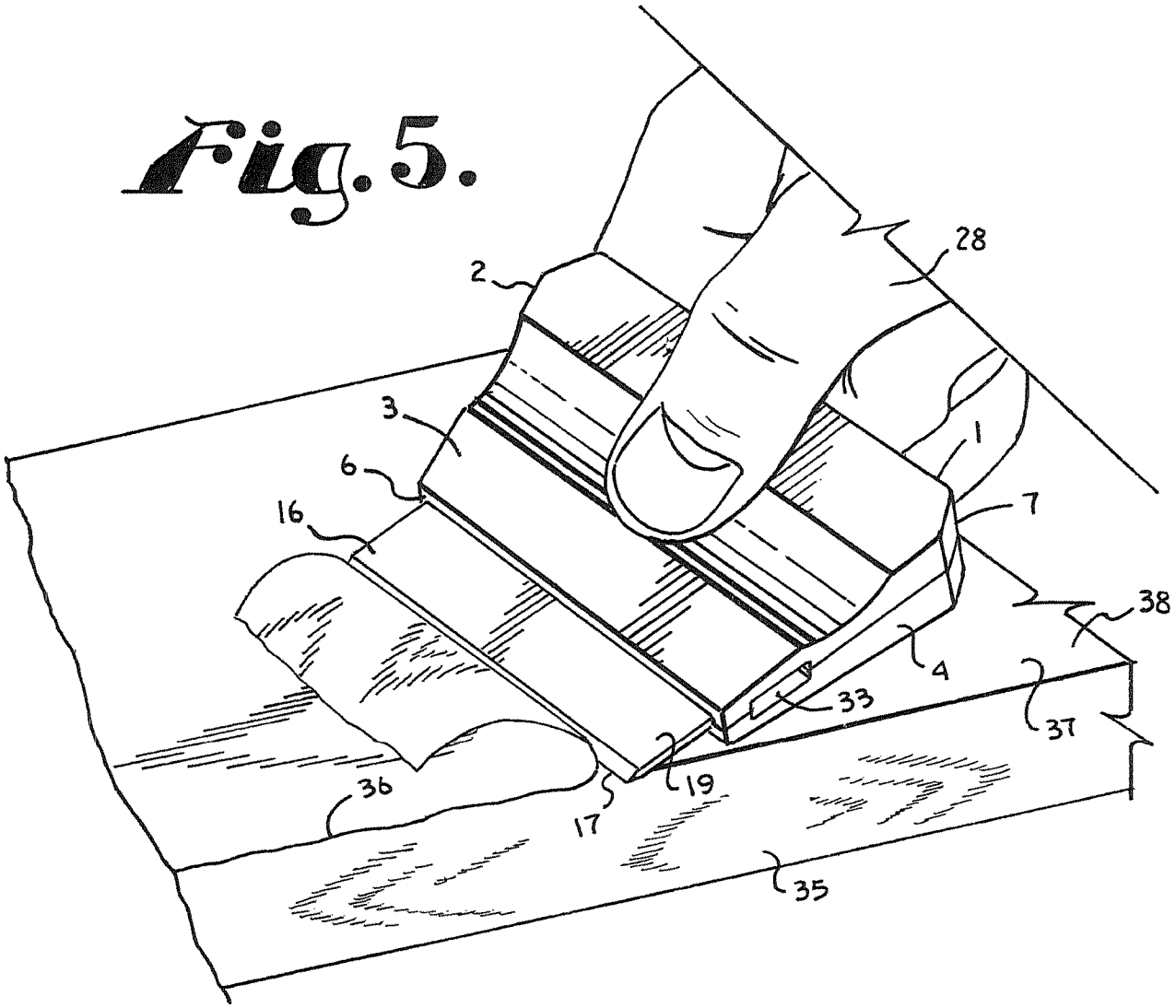
FIG. 5 is a perspective view of the scraper being held by a user and being used to smooth and finish a wooden board.

The scraper 1 with the blade 16 is principally for scraping, but can also be utilized for cutting or the like. As seen in FIG. 5, the scraper 1 is being used to smooth a board 35. The board 35 has an uneven surface 36 in front of the scraper 1 and a smooth or level surface 37 along a path 28 traveled by the scraper 1 (as best seen by the top front edge of the board 35).

It is to be understood that while certain forms of the present invention have been described and illustrated herein, it is not to be limited to the specific forms or arrangement of parts described and shown.

What is claimed and desired to be secured by Letters Patent is:

1. A method of providing a scraper for scraping a wide path comprising the steps of:

a) providing first and second body parts with a blade holding compartment;

b) providing an utility knife blade with an elongate sharpened edge as wide as the path and a trapezoidal shape with the sharpened edge being the longest edge of the blade;

c) placing the blade in the compartment so that an entire length of the bade sharpened edge extends from the body;

d) fixedly securing a magnet in each of the body parts; the magnets attracting each other and holding the blade in the body when the body is in a closed configuration of the scraper; the blade being removable from the body when the body parts are placed in an open configuration.

2. A scraper for use by a work person to scrape a surface with an elongate edge comprising:

a) a body having first and second parts; the body parts having an open configuration and a closed configuration;

b) a blade having rearward structure and an elongate edge opposite the rearward structure on a frontward structure;

c) at least the first part having a cavity sized and shaped to snugly receive the blade rearward structure; and d) a first and a second magnet received in the first and second body parts respectively; the magnets operably solely holding the blade within the body parts; the magnets also holding the body parts together when the body is in the closed configuration wherein the blade front end extends outwardly from the body so as to present an entire length of the edge for scrapping.

3. The scraper according to claim 2 wherein the body parts are hingedly joined opposite the blade.

4. The scraper according to claim 2 wherein each body part includes an outer non smooth with gripping structure to assist a user in gripping the scraper during usage.

5. The scraper according to claim 2 wherein the blade is highly magnetic and the magnets have a high magnetic field with a surface field of greater than about 3400 Gauss.

6. The scraper according to claim 2 wherein the blade is a utility knife blade.

7. The scraper according to claim 2 wherein the blade is trapezoidally shaped with the sharpened edge along a largest edge of the blade of greater than 2 inches in length; the body first part cavity is also trapezoidally shaped and sized and shaped to snugly receive the blade rearward structure; and the cavity opens outward without obstructions to the blade so that the blade is held in the body by the magnets attracting the blade.

8. The scraper according to claim 2 when the body has a storage compartment sized for holding at least one spare blade.

9. A scraper for use by a work person to scrape a surface with an elongate edge comprising:

a) a body having first and second parts; the body parts having an open configuration and a closed configuration;

b) a hinge joining the first and second parts near a rear of each of the first and second parts;

c) a blade being trapezoidally shaped with a front outward end being sharpened and being wider than a rearward end located on a rearward structure of the blade;

d) at least the first part having a cavity with an inner surface sized and shaped to mate with and receive the periphery of the blade rearward structure;

e) a first and a second magnet secured to the first and second body parts respectively; the magnets strongly attracting the blade and holding the blade in the cavity of the body; the magnets also holding the body parts together when in the closed configuration wherein the blade front end extends outwardly from the body so as to present an entire length of the edge for scrapping;

f) a groove grip enhancing structure on the exterior of the body to aid a user in gripping the scraper; and e) finger holds on each of the first and second parts to allow a user to pry the first and second parts into the open configuration thereof.

* * * * *